US010988336B2

(12) United States Patent
Miyazaki

(10) Patent No.: US 10,988,336 B2
(45) Date of Patent: Apr. 27, 2021

(54) IMAGE FORMING APPARATUS

(71) Applicant: KONICA MINOLTA, INC., Tokyo (JP)

(72) Inventor: Ken Miyazaki, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 231 days.

(21) Appl. No.: 16/376,423

(22) Filed: Apr. 5, 2019

(65) Prior Publication Data

US 2019/0322476 A1 Oct. 24, 2019

(30) Foreign Application Priority Data

Apr. 19, 2018 (JP) ..... JP2018-080560

(51) Int. Cl.
*B65H 7/02* (2006.01)
*B65H 5/06* (2006.01)
*G03G 15/00* (2006.01)

(52) U.S. Cl.
CPC ..... *B65H 7/02* (2013.01); *B65H 5/06* (2013.01); *G03G 15/502* (2013.01); *G03G 15/5029* (2013.01); *B65H 2511/13* (2013.01); *B65H 2511/414* (2013.01); *B65H 2511/416* (2013.01); *B65H 2515/10* (2013.01); *B65H 2515/112* (2013.01); *G03G 2215/00751* (2013.01)

(58) Field of Classification Search
CPC ..... G03G 15/502; G03G 15/5029; G03G 2215/00751; B65H 7/02; B65H 5/06; B65H 2515/10; B65H 2511/414; B65H 2511/416; B65H 2515/112; B65H 2511/13
See application file for complete search history.

(56) References Cited

U.S. PATENT DOCUMENTS 8,339,618 B2 * 12/2012 Stewart ..... G03G 15/502 358/1.12
9,389,821 B2 * 7/2016 Mihira ..... G06F 3/1204
9,471,266 B2 * 10/2016 Anno ..... G06F 3/1257
9,475,663 B2 * 10/2016 Takata ..... G03G 15/55
10,120,625 B2 * 11/2018 Kashiwagi ..... G06K 15/4065
10,514,649 B2 * 12/2019 Yamaoka ..... G03G 15/6594
2006/0262337 A1 * 11/2006 Kamata ..... G06F 3/1226 358/1.13

FOREIGN PATENT DOCUMENTS

JP 2014018974 A 2/2014
JP 2017170859 A 9/2017

* cited by examiner

*Primary Examiner* — Jeremy R Severson

(74) *Attorney, Agent, or Firm* — Holtz, Holtz & Volek PC

(57) ABSTRACT

An image forming apparatus includes: a sheet profile setter; a conveyer; an image former that forms an image on a sheet conveyed by the conveyer in accordance with an image forming condition; a sheet physical property measurer that makes measurement of a physical property value of the sheet; a conformity determiner that makes determination of conformity between the sheet fed from the sheet feed tray and a sheet indicated by the sheet profile set in the sheet feed tray; and a notifier that determines which has been performed more recently between insertion of the sheet into the sheet feed tray and setting of the sheet profile to the sheet feed tray before the measurement so as to send a notification of a result of the determination, by a first notification method in a former case and by a second notification method in a latter case.

8 Claims, 12 Drawing Sheets

FIG. 4

60

| TRAY NUMBER | STATE INFORMATION |
|---|---|
| 001 | INSERTED SHEET CONFIRMATION STATE |
| 002 | INSERTED SHEET CONFIRMATION STATE |
| 003 | SHEET SETTING CONFIRMATION STATE |
| 004 | INSERTED SHEET CONFIRMATION STATE |
| 005 | SHEET SETTING CONFIRMATION STATE |
| 006 | CONFIRMATION UNNECESSARY STATE |
| 007 | CONFIRMATION UNNECESSARY STATE |
| 008 | CONFIRMATION UNNECESSARY STATE |

FIG. 9

78

MACHINE STATE | JOB LIST | HDD READOUT

*PLEASE SET DESIGNATED SHEET
OR SELECT TRAY IN "DETAILED CONFIRMATION".

SHEETS IN TRAY 1 DO NOT MATCH.
CORRECT TRAY?
PLEASE CHECK.

MEDIA SENSING RESULT

MISMATCH

MATCHING RATIO: 38%

SHEET TYPE: PLAIN PAPER

BASIS WEIGHT: 73g/m$^2$

| | |
|---|---|
| PROFILE No. | ----- |
| SIZE | A4 |
| SHEET TYPE | PLAIN PAPER |
| SHEET PROFILE | ----- |
| BASIS WEIGHT | 62–74g/m$^2$ |
| COLOR PAPER | WHITE |
| PUNCH | NO PUNCH HOLE |
| INDEX NUMBER | ----- |

CLOSE

FIG. 12

85

SETTING MENU

*MEASUREMENT RESULT

AS MEASUREMENT RESULT, PROFILES SIMILAR TO FOLLOWING CANDIDATES ARE FOUND.
FOUND PROFILE CANDIDATES CAN BE CONFIRMED BY PRESSING [PROFILE CANDIDATE].
SELECTED MEASUREMENT RESULT CAN BE REGISTERED BY PRESSING [REGISTER TO PROFILE].

MEASUREMENT RESULT

| No | SHEET TYPE | BASIS WEIGHT | MATCHING RATIO | SETTABLE COMBINATION |
|---|---|---|---|---|
| 001 | COATED PAPER GL | 81–91g/m$^2$ | 90% | UNSETTABLE |
| 002 | COATED PAPER GL | 75–80g/m$^2$ | 85% | UNSETTABLE |
| 003 | COATED PAPER MO | 81–91g/m$^2$ | 80% | UNSETTABLE |
| 004 | COATED PAPER MO | 81–91g/m$^2$ | 75% | UNSETTABLE |

PROFILE CANDIDATE

TRAY TO WHICH SELECTED SETTING IS APPLIED

TRAY 1 TRAY 2 TRAY 3 TRAY 4
TRAY 5 TRAY 6 TRAY 7 TRAY 8

REGISTER TO PROFILE CLOSE APPLY TO SELECTED TRAY

IMAGE FORMING APPARATUS

The entire disclosure of Japanese patent Application No. 2018-080560, filed on Apr. 19, 2018, is incorporated herein by reference in its entirety.

BACKGROUND

Technological Field

The present invention relates to an image forming apparatus having a function of determining conformity between a sheet profile set in a sheet feed tray and sheets inserted in the sheet feed tray.

Description of the Related Art

The quality of the output image in the image forming apparatus largely depends on whether respective characteristics (conveyance characteristics, transfer characteristics, fixing characteristics, etc.) of the image forming apparatus and the sheet properties (sheet type, basis weight, etc.) are compatible with each other. Therefore, it is necessary to change the values of the various parameters related to the image forming condition on the image forming apparatus side according to the properties of the sheet to be used. It takes time and effort to set values of many parameters separately and accurately, and setting mistakes easily occur. Therefore, reducing the amount of work and preventing the occurrence of mistakes are attempted by configuring the apparatus so that a sheet profile aggregating the properties (attributes) of the sheets and the values of the parameters of the apparatus corresponding to the properties are prepared in advance to be registered in a database or the like for each type of sheets to be used, and so that it is sufficient to select and designate the sheet profile corresponding to the sheet to be used at the time of image formation.

The operator may perform (1) an operation of setting, in a sheet feed tray to be used for the job, a sheet profile corresponding to the sheet to be inserted into the sheet feed tray, and (2) an operation of setting a corresponding type of sheets in the sheet feed tray. When executing a job, the image forming apparatus reads the sheet profile set in the sheet feed tray designated as the sheet feed source in the job, sets image forming parameters and the like on the apparatus side according to the sheet profile, and feeds sheet from the sheet feed tray designated as the sheet feed source in the job for image formation.

Even if the work is simplified by using the sheet profile as described above, erroneous setting or the like due to human mistake is not completely eliminated. For example, an operator may set an incorrect sheet profile in the sheet feed tray. Also, an operator may insert an incorrect type of sheets into the sheet feed tray.

As a technique for dealing with such human mistake, JP 2014-18974 A discloses an image forming apparatus which determines a sheet feed tray on which a sheet change operation has been performed by an operator based on opening/closing detection of the sheet feed tray, and gives a warning while prompting the user to confirm the sheet attribute (sheet profile) set for the sheet feed tray.

Also, in recent years, media sensors capable of measuring various physical property values of sheets, such as smoothness, have been developed, and before setting sheets in the sheet feed tray, physical property values of sheets are measured with a media sensor, so that the conformity between the measurement result and a previously registered sheet profile is determined and sheet profiles are displayed in descending order of degree of conformity in a list so that mistakes in sheet profile selection are prevented.

Further, there is an image forming apparatus which has a media sensor provided on a sheet conveyance path and measures the physical property value of a sheet fed from the sheet feed tray by the media sensor, and then stops the conveyance of the sheet when a sheet having a property different from the property of the sheet registered in the storage section and used in the past printing is detected (for example, refer to JP 2017-170859 A).

By providing a media sensor on the conveyance path, whether the sheet fed from the sheet feed tray conforms to (agrees with) the sheet profile set for that sheet feed tray can be determined. However, in the case where the sheet and the sheet profile do not conform to each other, there are cases where the operator mistakes the sheet feed tray for placing the sheets and mistakes the sheet profile set in the sheet feed tray.

If the sheets are inserted in a wrong sheet feed tray, the sheets must be reloaded in the correct sheet feed tray. It takes a great deal of time and effort to take out large amounts of sheets while carefully paying attention not to damage the sheets. If an incorrect sheet profile is set in the sheet feed tray, the correct sheet profile needs to be reset, and since this mistake is noticed only after start of the print job operation in many cases, a lot of sheets and toner are wasted.

In this way, though the countermeasures become greatly different depending on the cause of nonconformity, the conventional image forming apparatus cannot determine the cause of nonconformity, so that the problem after detection of nonconformity cannot be smoothly coped with.

SUMMARY

The present invention is intended to solve the above problem, and an object thereof is to provide an image forming apparatus capable of determining whether the cause is the sheet misplacement or the sheet profile mis-setting and making a notification, when the sheets set in a sheet feed tray do not conform to the sheet profile set in the sheet feed tray.

To achieve the abovementioned object, according to an aspect of the present invention, an image forming apparatus reflecting one aspect of the present invention comprises:

a sheet profile setter that sets a sheet profile in a sheet feed tray;

a conveyer that feeds and conveys a sheet from the sheet feed tray;

an image former that forms an image on the sheet conveyed by the conveyer in accordance with an image forming condition determined based on the sheet profile set in the sheet feed tray of a sheet feed source;

a sheet physical property measurer that makes measurement of a physical property value of the sheet being conveyed on a conveyance path of the conveyer;

conformity determiner that makes determination of conformity between the sheet fed from the sheet feed tray and a sheet indicated by the sheet profile set in the sheet feed tray, based on the physical property value obtained by measuring the sheet fed and conveyed from the sheet feed tray, by the sheet physical property measurer; and a notifier that determines which has been performed more recently between insertion of the sheet into the sheet feed tray and setting of the sheet profile to the sheet feed tray before the measurement relating to the determination made by the conformity determiner so as to send a notification of a result of the determination by a first notification method in a former case and by a second notification method in a latter case.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram showing an example of a state information management table in which state information indicating a state of a sheet feed tray is registered for each sheet feed tray;

FIG. 9 is a diagram showing an example of a reconfirmation screen displayed on the operation panel of the image forming apparatus;

FIG. 12 is a diagram showing an example of a recommended sheet setting screen displayed on the operation panel of the image forming apparatus.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
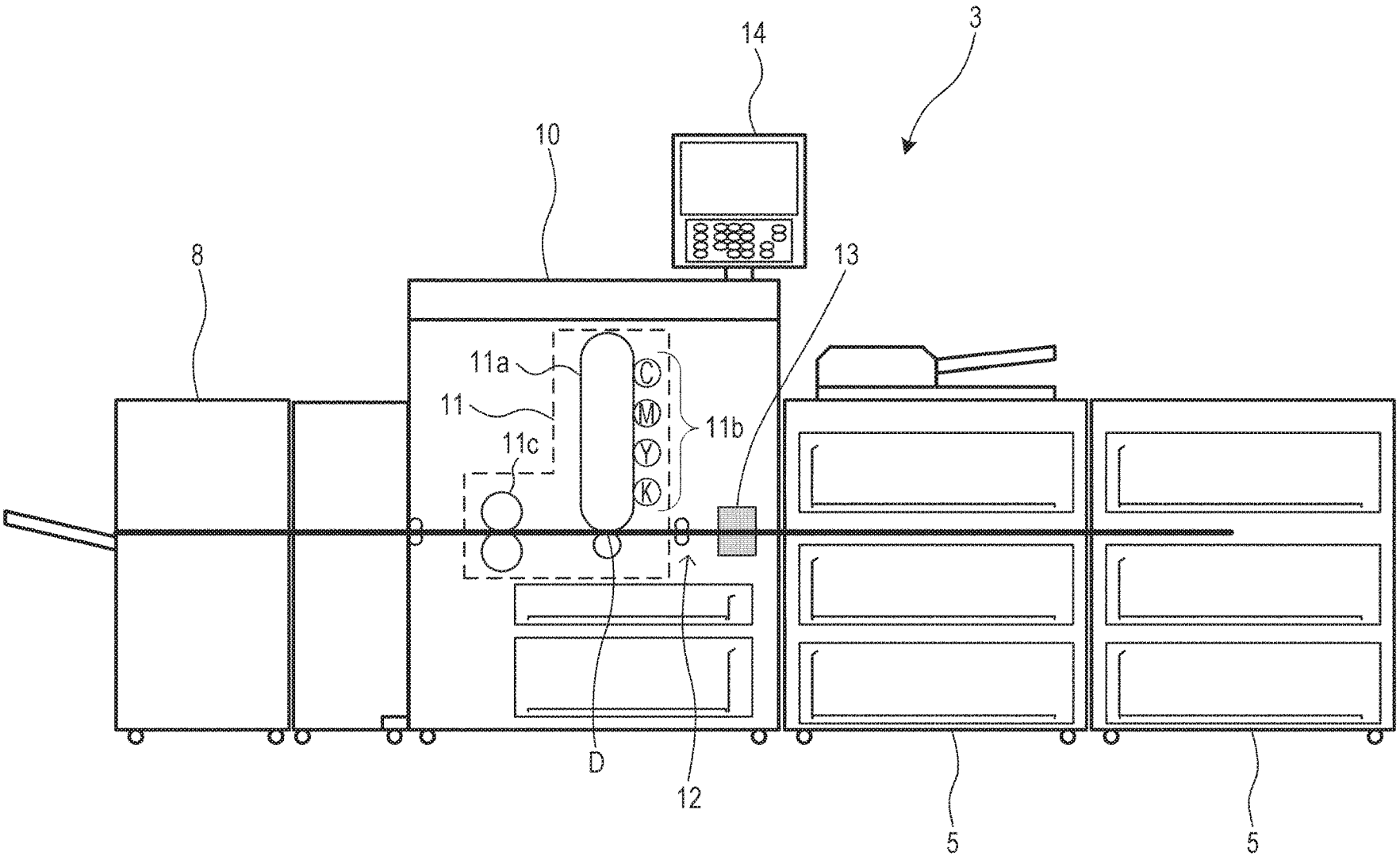
FIG. 1 is a diagram showing a configuration of an image forming system including an image forming apparatus according to an embodiment of the present invention.

FIG. 1 is a diagram showing an image forming system 3 including an image forming apparatus according to an embodiment of the present invention. The image forming system 3 includes a plurality of sheet feeding units 5, an image forming apparatus 10, and a post-processing unit 8. The sheet feeding units 5 include a plurality of sheet feed trays for storing sheets, and feeds the sheet stored in each sheet feed tray to convey the sheet to the image forming apparatus 10. The image forming apparatus 10 forms an image on the sheet conveyed from the sheet feeding unit 5 and sends the sheet to the post-processing unit 8 in the subsequent stage. The post-processing unit 8 performs a function of applying post-processing such as punching, binding, or folding to the sheet received from the image forming apparatus 10, and a function of stacking to hold the sheets received from the image forming apparatus 10 or the sheets post-processed by the unit.

The image forming apparatus 10 includes a conveyer 12 for conveying a sheet coming from the sheet feeding unit 5 and an image former 11 for forming an image on the sheet conveyed by the conveyer 12. The conveyer 12 is composed of a number of conveying rollers constituting a conveyance path, conveying guides, motors driving the conveying rollers, and the like. The image former 11 includes an intermediate transfer belt 11*a* stretched circularly in an endless manner, image forming units 11*b* of respective colors C, M, Y, and K arranged along the intermediate transfer belt 11*a*, and a fixing device 11*c*, and the like.

The image former 11 superimposes toner images of respective colors C, M, Y, and K on the intermediate transfer belt 11*a* by the image forming unit 11*b* to form a full color toner image. The toner image formed on the intermediate transfer belt 11*a* is transferred to the sheet conveyed from the sheet feeding unit 5 at a secondary transfer position D. The sheet on which the toner image has been transferred is pressurized and heated for fixing the image while being passed through the fixing device 11*c* located downstream. The sheet discharged from the fixing device 11*c* is conveyed to the post-processing unit 8 in the subsequent stage by the conveyer 12. The image former 11 of the image forming apparatus 10 is not limited to the tandem type electrophotographic system as described above.

At a predetermined position on the conveyance path in the image forming apparatus 10, a media sensor (sheet physical property measurer) 13 that functions to measure various physical property values of the sheet being conveyed is provided.

Further, the image forming apparatus 10 includes an operation panel 14 performing a function of accepting various operations from the operator, and a function of displaying a setting screen/operation screen, apparatus state, warning, and the like.

The image forming apparatus 10 is configured to set a sheet profile for each sheet feed tray, and forms an image under the image forming conditions determined on the basis of the sheet profile set in the sheet feed tray when forming an image on a sheet fed from a sheet feed tray. The sheet profile is an aggregation of information indicating the attributes/properties (sheet type, basis weight) of the sheet. For example, the image forming apparatus 10 switches the conveyance speed of the sheet and the fixing temperature on the basis of information on basis weight or the like registered in the sheet profile. In the sheet profile, various parameter values (for example, positions of punch holes) the image forming apparatus side to be used when an image is formed on a sheet may be additionally registered.

The image forming apparatus 10 measures various physical property values of the sheet fed and conveyed from the sheet feed tray by using the media sensor 13, and based on the measurement result, determines conformity between this sheet and the sheet profile set in the sheet feed tray of the sheet feed source. Then, image forming apparatus 10 has a sheet conformity determining function of notifying the operator of a warning and coping method for the state when determining that the sheet and the sheet profile set in the sheet feed tray of the sheet feed source do not conform to each other (mismatch). At the time of notification, it is determined whether the cause of nonconformity (mismatch)

is a mistake in placing sheets in the sheet feed tray or a sheet profile setting error to the sheet feed tray, and the operator is notified of the cause frog the nonconformity and a coping method corresponding to its cause.

The image forming apparatus 10 has a function of registering each physical property value obtained by measurement by the media sensor 13 in a designated sheet profile. Physical property values measured by an external media sensor may be acquired and registered in the sheet profile.

Figure 2:
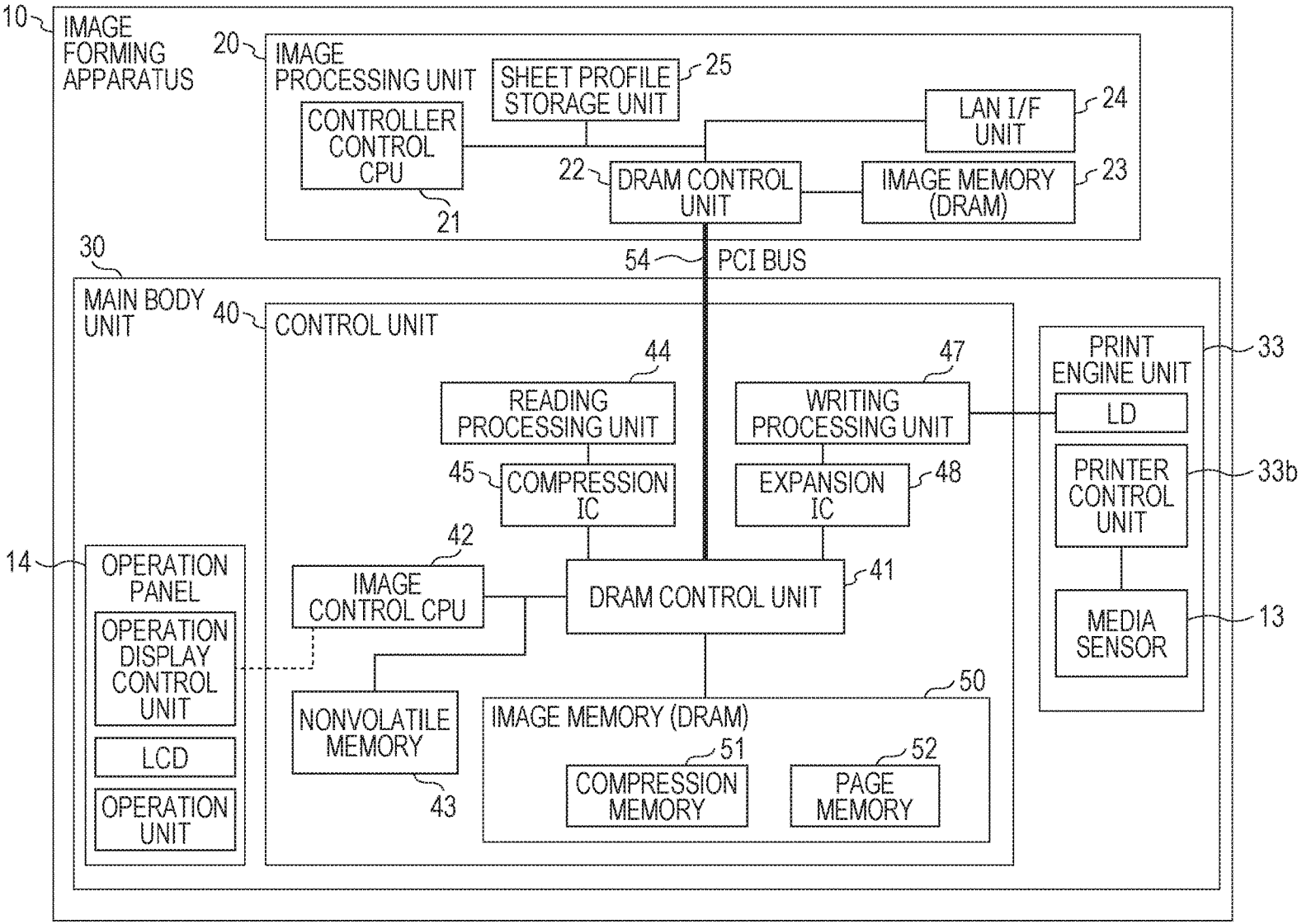
FIG. 2 is a block diagram showing an electrical schematic configuration of the image forming apparatus.

FIG. 2 is a block diagram showing an electrical schematic configuration of the image forming apparatus 10. The image forming apparatus 10 includes an image processing unit 20 and a main body unit 30, and an external terminal such as a PC terminal is connected to the image processing unit 20 via a network such as a LAN. The image processing unit 20 performs a raster image processor (RIP) function or the like for rasterizing print data relating to a print job sent from an external terminal and generating bitmap format image data.

The image processing unit 20 includes a controller control central processing unit (CPU) 21 that totally controls the operation of the image processing unit 20, a LAN interface (I/F) unit 24 that performs a communication function for connecting to the LAN, an image memory 23 storing image data, etc. generated by a RIP processing, a dynamic random access memory (DRAM) control unit 22 for performing a data read/write function for the image memory 23, transferring the image data to the main body unit 30, and the like, and a sheet profile storage unit 25 for storing a member of sheet profiles.

In addition to this, a read only memory (ROM) storing programs to be read and executed by the controller control CPU 21 and fixed data, and a random access memory (RAM) used as a work memory for storing various data temporally when the controller control CPU 21 executes programs are connected to the controller control CPU 21.

The main body unit 30 is configured by connecting the operation panel 14 and a print engine unit 33 to a control unit 40 that controls the operation of the main body unit 30. In addition to the image former 11, the conveyer 12, and the media sensor 13, the print engine unit 33 includes a printer control unit 33*b* that controls the overall operation of the print engine unit 33. Various electrical components such as the media sensor 13, and a motor, solenoid, sensor, etc. of the print engine unit 33 described earlier are connected to the printer control unit 33*b*.

The operation panel 14 includes a liquid crystal display (LCD), an operation unit having a touch switch and other switches laid on the screen, and an operation display control unit (CPU) for controlling these units.

The control unit 40 functions to comprehensively control the operation of the main body unit 30 of the image forming apparatus 10, and includes a DRAM control unit 41, an image control CPU 42, a nonvolatile memory 43, a reading processing unit 44, a compression integrated circuit (IC) 45, a writing processing unit 47, an expansion IC 48, an image memory 50 composed of a semiconductor memory, and the like.

The reading processing unit 44 carries out a function of performing enlargement processing, mirror image processing, error diffusion processing, and the like on the input image data. The compression IC 45 compresses the image data, and the expansion IC 48 performs the function of expanding the image data having been compressed (compressed image data) to the original image data.

The image memory 50 is used as a function as a page memory 52 capable of storing uncompressed image data on a page basis, and as a compression memory 51 for storing compressed image data, and the like.

The writing processing unit 47 performs a function of outputting signals for turning on/off the laser diode (LD) of the image forming unit 11*b*, at a timing according to the operation of the image former 11 in accordance with the image data read out from the compression memory 51 and expanded.

The DRAM control unit 41 performs timing control of read/write and refresh for the image memory 50 made of dynamic RAM, and timing control when compressing the image data and storing the data in the compression memory 51, and when reading compressed image data from the compression memory 51 and expanding the data. The DRAM control unit 41 is connected to the DRAM control unit 22 of the image processing unit 20 through a peripheral component interconnect (PCI) bus 54, and performs a function of exchanging various data with the image processing unit 20 via the PCI bus 54.

The image control CPU 42 fulfills a function of controlling the overall operation of the main body unit 30. The image control CPU 42 is composed of a CPU, a circuit mainly including a ROM and a RAM, and executes various types of control according to programs stored in the ROM. The ROM stores programs, various types of fixed data, and the like, and the CPU operates in accordance with programs stored in the ROM. The RAM is used as a work memory for temporarily storing various types of data when the CPU executes the programs.

The nonvolatile memory 43 is a memory that stores user data, system data, and the like that should be stored even after the power is turned off.

By executing the program, the image control CPU 42 functions as a conformity determiner, notifier, state manager, measured value register, and the like. Based on the physical property values obtained by measuring the sheet delivered from the sheet feed tray by the media sensor 13, the conformity determiner determines the conformity between the sheet fed out from the sheet feed tray and the sheet indicated by the sheet profile set in the sheet feed tray of the sheet feed source.

The notifier notifies the operator of the determination result of the conformity determiner. Notification may be made by voice in addition to by display. The notifier determines which of operations, which are the insertion of the sheets into the sheet feed tray and the setting of the sheet profile to the sheet feed tray, has been performed more recently before the measurement of the physical property value related to the determination made by the conformity determiner, so that notification of the result of the determination by the conformity determiner is made by the first notification method, in the former case (when insertion of sheets into the sheet feed tray has been performed just before the measurement), and notification of the result of the determination by the conformity determiner is made by the second notification method, in the latter case (when the setting of the sheet profile to the sheet feed tray has been performed just before the measurement).

The measured value register functions to register the physical property value obtained by measuring the sheet with the media sensor 13 in the sheet profile.

The state manager manages the state information of the sheet feed tray as three states to be described later.

Note that the configuration of the image forming apparatus 10 shown in FIG. 2 is merely an example, and the present invention is not limited thereto.

Figure 3:
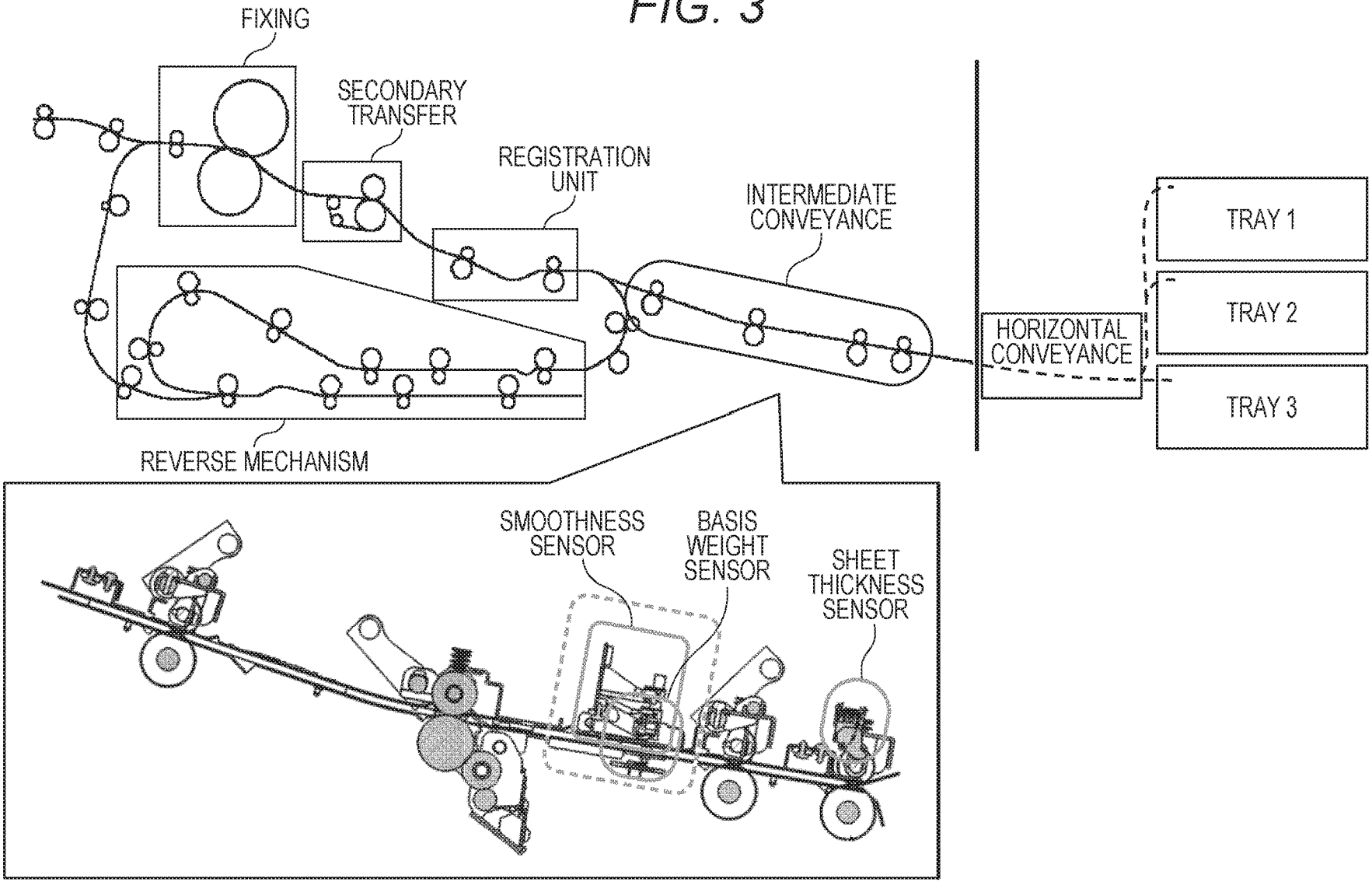
FIG. 3 is a diagram showing a mounting position, a structure, and the like of a media sensor.

FIG. 3 shows the mounting position, structure and the like of the media sensor 13. The conveyance path of the sheet fed out from each sheet feed tray is provided so as to pass through a horizontal conveyance, an intermediate conveyance, a registration portion, the secondary transfer position D, and the fixing device Ile after joining at the downstream of each sheet feed tray. As a part of the conveyance path, a reverse mechanism for reversing the front and back of the sheet for duplex printing is provided.

The media sensor 13 is provided for the intermediate conveyance and is constituted by a sheet thickness sensor, basis weight sensor, smoothness sensor, and the like.

Next, the sheet conformity determination function of the image forming apparatus 10 of the image forming system 3 will be described.

The image forming apparatus 10 manages the sheet feed tray in the following three stages for each sheet feed tray.

(1) Inserted Sheet Confirmation State

This is a state indicating that it is necessary to measure the physical property value of the sheet with the media sensor 13, and between the setting of the sheet profile for the sheet feed tray and the setting of the sheets on the sheet feed tray (opening and closing of the sheet feed tray), the opening and closing of the sheet feed tray has been done more recently.

(2) Sheet Setting Confirmation State

This is a state indicating that it is necessary to measure the physical property value of the sheet with the media sensor 13, and between the setting of the sheet profile for the sheet feed tray and the setting of the sheets on the sheet feed tray (opening and closing of the sheet feed tray), the setting of the sheet profile for the sheet feed tray is done more recently.

(3) Confirmation Unnecessary State

This is a state in which it is unnecessary to measure the physical property value of the sheet with the media sensor 13.

That is, the inserted sheet confirmation state indicates that sheet insertion has been recently performed, among the three events of the insertion of sheet into the sheet feed tray, setting of the sheet profile to the sheet feed tray, and measurement of physical property values of the sheet fed out from the sheet feed tray by the media sensor 13, and the sheet setting confirmation state indicates that the setting of the sheet profile to the sheet feed tray has been recently performed, among the above three events and the confirmation unnecessary state indicates that the measurement of the physical property value by the media sensor 13 has been recently performed among the above three events, FIG. 4 shows an example of a state information management table 60 in which the state information indicating the state of the sheet feed tray is registered for each sheet feed tray.

Figure 5:
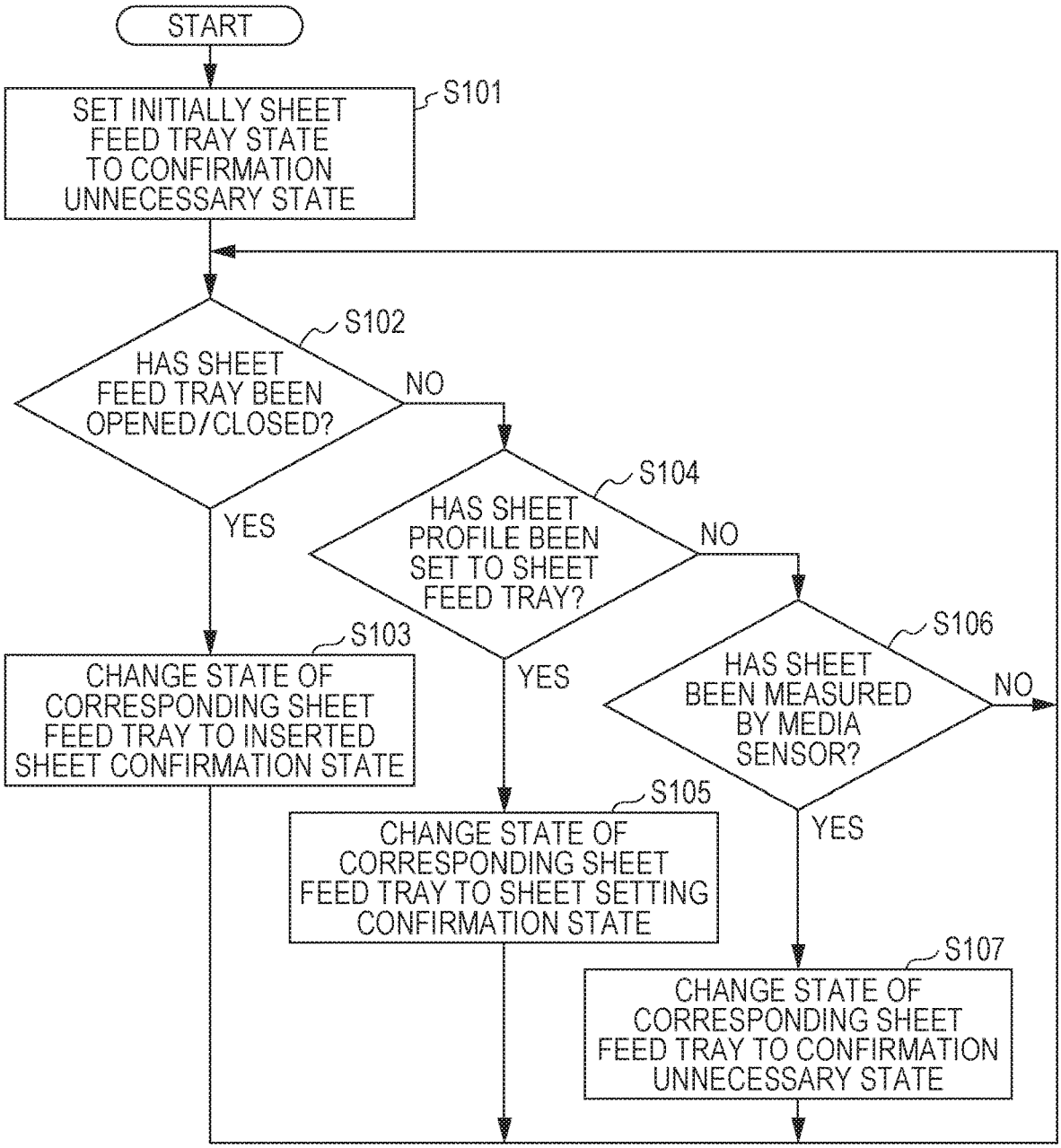
FIG. 5 is a flowchart showing processing of updating state information of each sheet feed tray.

FIG. 5 is a flowchart showing the processing of the image forming apparatus 10 for updating the state information of each sheet feed tray. First, the state information of the sheet feed tray is initialized to "confirmation unnecessary state" (step S101). After that, the following monitoring is continuously performed, and the state information of the sheet feed tray is changed each time a corresponding event occurs. To be more specific, opening/closing of the sheet feed tray is monitored, and when the sheet feed tray is opened and closed (step S102; Yes), the state information of the sheet feed tray is changed to "inserted sheet confirmation state" (step S103).

In addition, monitoring is made to determine whether a sheet profile has been set for the sheet feed tray and whether the set sheet profile has been changed, and if any one of the event occurs (step S104; Yes), the state information of the sheet feed tray is changed to "sheet setting confirmation state" (step S105).

When the physical property value of the sheet is measured using the media sensor 13 (step S106; Yes), the state information of the sheet feed tray at the sheet feed source of the sheet is changed to "confirmation unnecessary state".

Next, the processing related to the sheet conformity determination function in which the image forming apparatus 10 determines the conformity between the sheets set in the sheet feed tray and the sheet profile set in the sheet feed tray, and in case of nonconformity (mismatch), the operator is notified of a warning or coping method will be described. This processing is executed, for example, when trial printing for aligning an image on the front side of the sheet and an image on the back side (front-back adjustment). In trial printing for front and back adjustment, a register mark for positioning is printed on the sheet.

Figure 6:
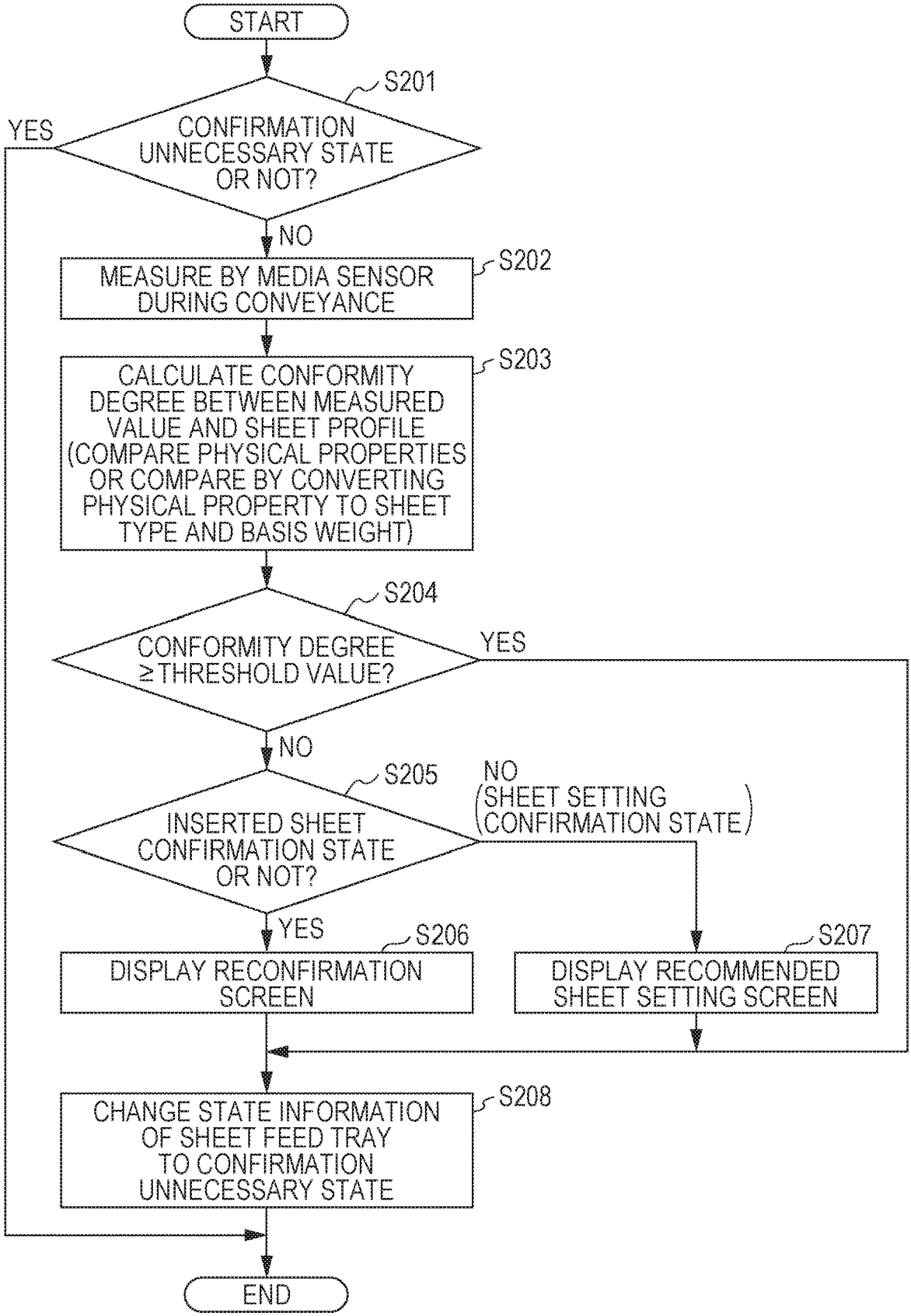
FIG. 6 is a flowchart showing processing of determining a conformity between a sheet measured by the media sensor and a sheet profile set in the sheet feed tray and notifying the determination result.

FIG. 6 is a flowchart showing the processing according to the sheet conformity determination function, Here, it is assumed that this processing is executed when trial printing for front and back adjustment is performed, The image forming apparatus 10 checks whether the state information of the sheet feed tray set as the sheet feed source of the sheet is "confirmation unnecessary state" (step S201) when performing trial printing for front/back adjustment. When the state information of the sheet feed tray set as the sheet feed source is the "confirmation unnecessary state" (step S201; Yes), it is determined that the conformity determination is unnecessary, so that trial printing is performed and the present processing is terminated.

If the state information of the sheet feed tray set as the sheet feed source is not "confirmation unnecessary state", trial printing is started and the physical property value of the sheet being conveyed in the test printing is measured by the media sensor 13 (step S202).

Next, based on the physical property values measured by the media sensor 13, the image forming apparatus 10 calculates the conformity degree between the sheets set in the sheet feed tray of the sheet feed source and the sheet profile set in the sheet feed tray (step S203).

To calculate the degree of conformity, one of the following two methods A and B is used.

(Method A)

The physical property value of the item to be measured by the media sensor 13 is registered in advance in the sheet profile, and the physical property value obtained by measuring the sheet being conveyed by the media sensor 13 is compared with the physical property value registered in the sheet profile set in the sheet feed tray of the sheet feed source so that the degree of conformity is acquired. The image forming apparatus 10 has a function of registering each physical property value measured by the media sensor 13 in a designated sheet profile.

(Method B)

From physical property values obtained by measuring the sheet being conveyed by the media sensor 13, a sheet type and a basis weight corresponding to the physical property value are obtained, and the obtained sheet type and basis weight and a sheet type and basis weight registered in the sheet profile are compared with each other to calculate the degree of conformity. In the method B, for example, a conversion table for converting physical property values into a sheet type and basis weight is prepared beforehand, and by referring to the conversion table by using the physical property value obtained by actual measurement, the physical property value is converted into the sheet type and basis weight.

When the calculated degree of conformity is equal to or larger than a threshold value (step S204; Yes), it is determined that the combination of the sheets set in the sheet feed tray of the sheet feed source and the sheet profile set in the sheet feed tray is conformable (agreeable) and the processing proceeds to step S208.

When the calculated degree of conformity is less than the threshold value (step S204; No), it is determined that the sheets set in the sheet feed tray of the sheet feed source and the sheet profile set in the sheet feed tray do not conform to (agree with) each other. Then, it is confirmed whether the state information of the sheet feed tray of the sheet feed source is "inserted sheet confirmation state" or "sheet setting confirmation state" (step S205).

When the state information of the sheet feed tray of the sheet feed source is "inserted sheet confirmation state" (step S205; Yes), since the opening and closing of the sheet feed tray has been done more recently before this trial printing, between setting of the sheet profile for the sheet feed tray and setting of the sheets to the sheet feed tray (opening and closing of the sheet feed tray), it is determined that the cause nonconformity is a setting mistake of the sheets in the sheet feed tray. Then, a reconfirmation screen to be described later notifying the operator that the cause of the nonconformity is a sheet mis-setting is displayed (step S206), and the processing proceeds to step S208.

When the state information of the sheet feed tray of the sheet feed source is the "sheet setting confirmation state" (step S205; No), since the setting of the sheet profile is performed more recently before this trial printing, between the setting of the sheet profile for the sheet feed tray and the setting of the sheets in the sheet feed tray (the opening and closing of the sheet feed tray), it is determined that the setting error of the profile for the sheet feed tray of the sheet feed source is a cause of nonconformity. Then, the operator is notified that the cause of the nonconformity is a setting mistake of the sheet profile, a recommended sheet setting screen to be described later suitable for the handling action is displayed (step S207), and the processing proceeds to step S208.

In step S208, the state information of the sheet feed tray of the sheet feed source is changed to "confirmation unnecessary state", and the present processing is terminated. Incidentally, step S208 corresponds to step S107 in FIG. 5.

When there are a plurality of sheet feed trays to be used in the print job, the processing in FIG. 6 is performed for each of the plurality of sheet feed trays. Further, the processing in FIG. 6 may be performed on trial printing for front and back adjustment, or may be executed based on individual instructions from the operator. For example, after accepting designation of the sheet feed tray to be checked, the image forming apparatus 10 executes processing shown in FIG. 6 for each sheet feed tray designated as a check target, upon receiving an instruction to execute the sheet conformity determination function from the operator. At this time, the sheet may be fed out only from the sheet feed tray whose state information is not "confirmation unnecessary state" (a tray in the "inserted sheet confirmation state" or "sheet setting confirmation state"), and measured by the media sensor 13 for determination of the conformity degree.

Next, the flow of work performed by the operator at the time of printing, operations related to the sheet conformity determining function, and display screens will be described.

In Case of Sheet Insertion After Setting Sheet Profile (1) After setting the sheet profile in each sheet feed tray to be used in the print job, the operator opens and closes the sheet feed tray for inserting the sheets into each sheet feed tray to set the sheets.

(2) Every time the above operation is received, the image forming apparatus 10 transmits the state information of the sheet feed tray having been opened and closed to "inserted sheet confirmation state" (step S103 in FIG. 5).

Figure 7:
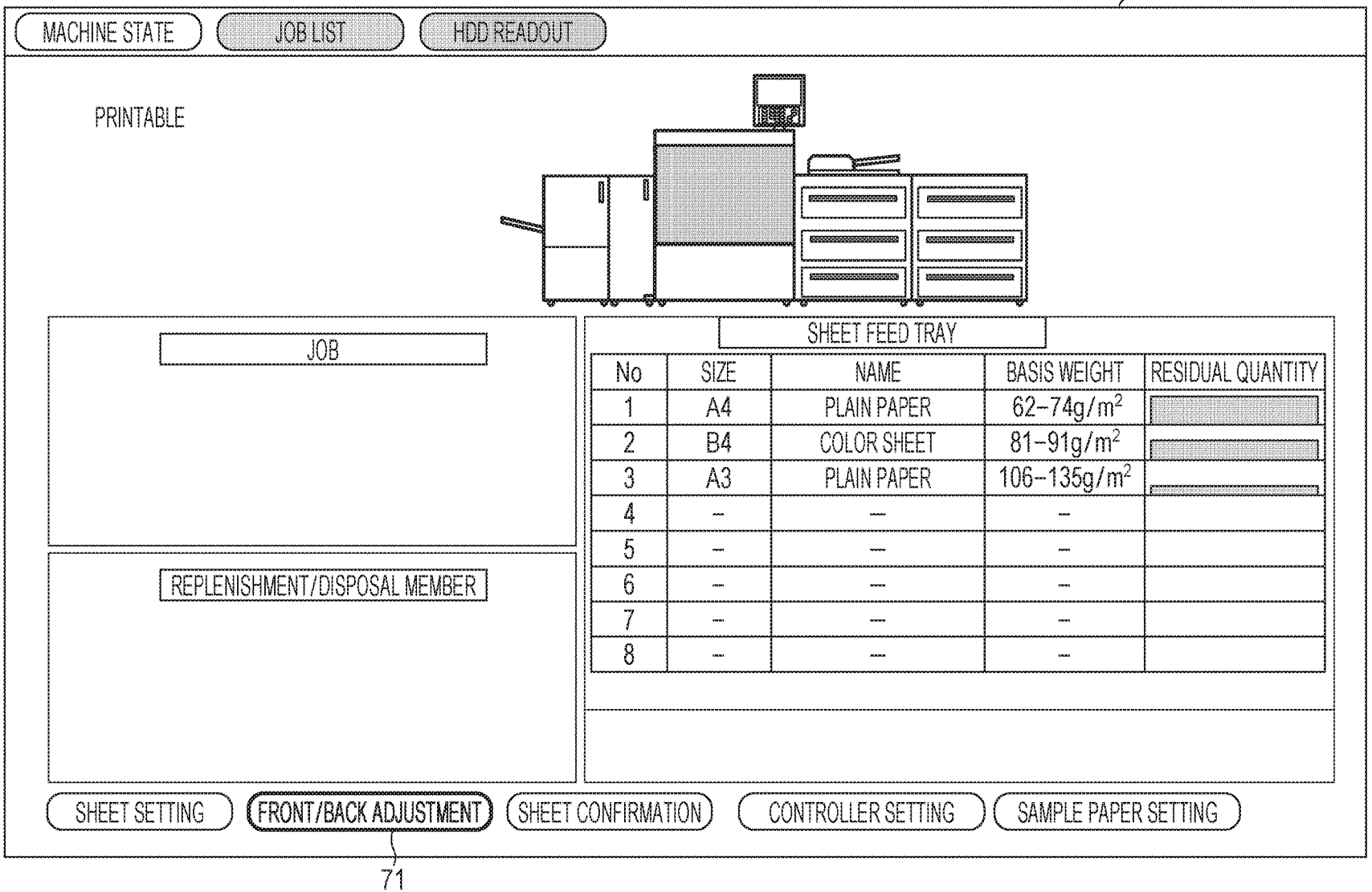
FIG. 7 is a diagram showing an example of an operation screen displayed on an operation panel of the image forming apparatus (in the case of pressing a front/back adjustment button)
Figure 8:
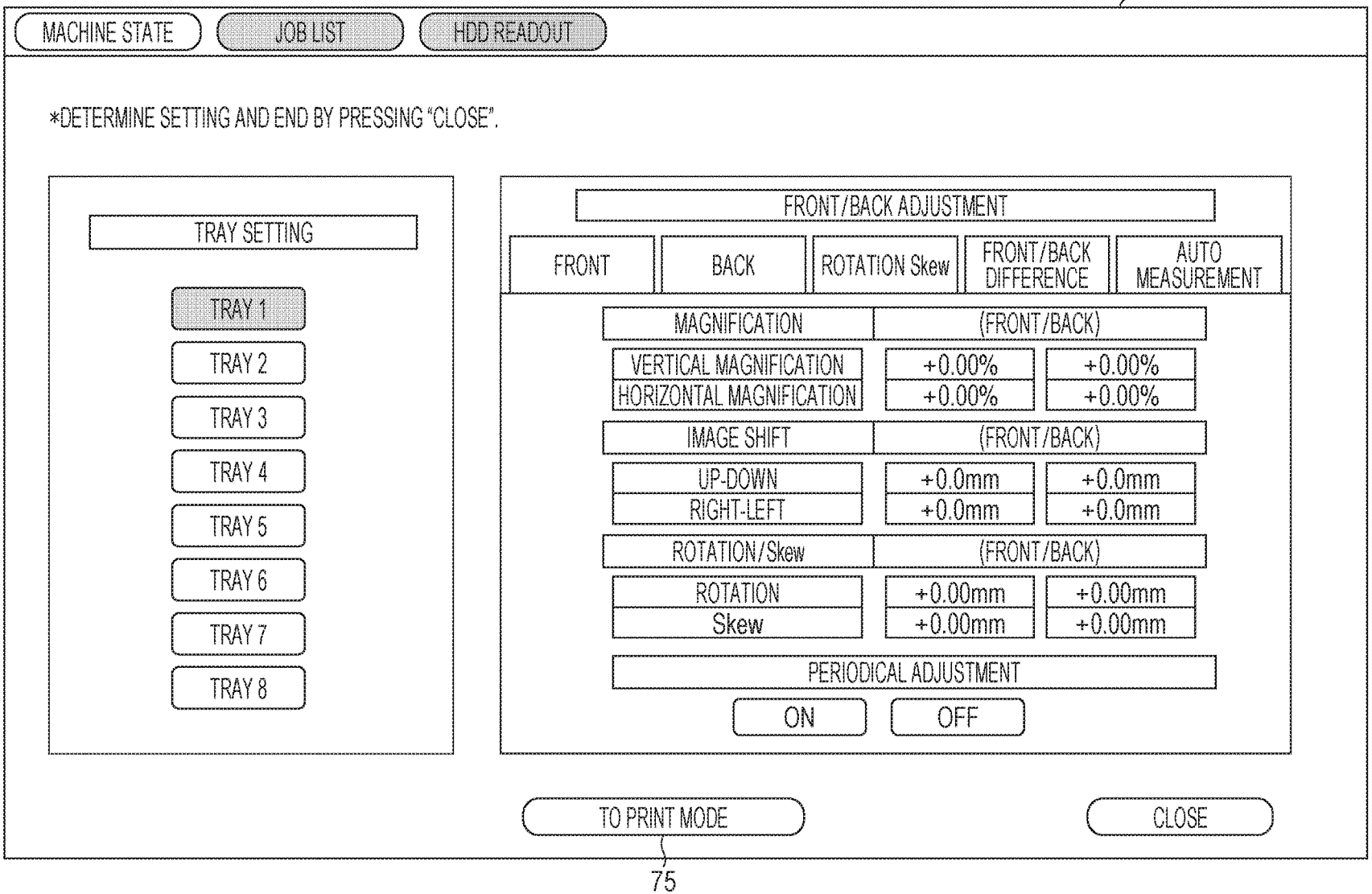
FIG. 8 is a diagram showing an example of a front/back adjustment value setting screen displayed on the operation panel of the image forming apparatus.

(3) When having inserted the sheets into all necessary sheet feed trays, the operator presses a front/back adjustment button 71 on an operation screen 70 (see FIG. 7) displayed on the operation panel 14, and gives an instruction to execute the front and back adjustment. When it is necessary to change the positions of the front and back sides and the like for adjustment, the operator opens a front/back adjustment value setting screen 74 shown in FIG. 8 and changes the setting of the adjustment value. When the setting of the adjustment value is completed and when a "to print mode" button 75 is pressed, the screen is returned to the operation screen 70 in FIG. 7.

(4) The image forming apparatus 10 performs the processing in FIG. 6 at the time of front-back adjustment printing (trial printing). In this case, if No (nonconformity) is determined in step S204, the processing proceeds to step S206 and displays a reconfirmation screen 78 as shown in FIG. 9, which suggests sheet misplacement. Further, the state information of the sheet feed tray of the sheet feed source is changed to "confirmation unnecessary state" (step S208).

The reconfirmation screen 78 notifies that the sheets placed in the sheet feed tray (tray 1 in this example) of the sheet feed source are unconformable (mismatched) with the sheet profile set in the tray 1, and indicates that the cause of the nonconformity is a mistake of the sheet feed tray on which the sheets has been set.

Figure 10:
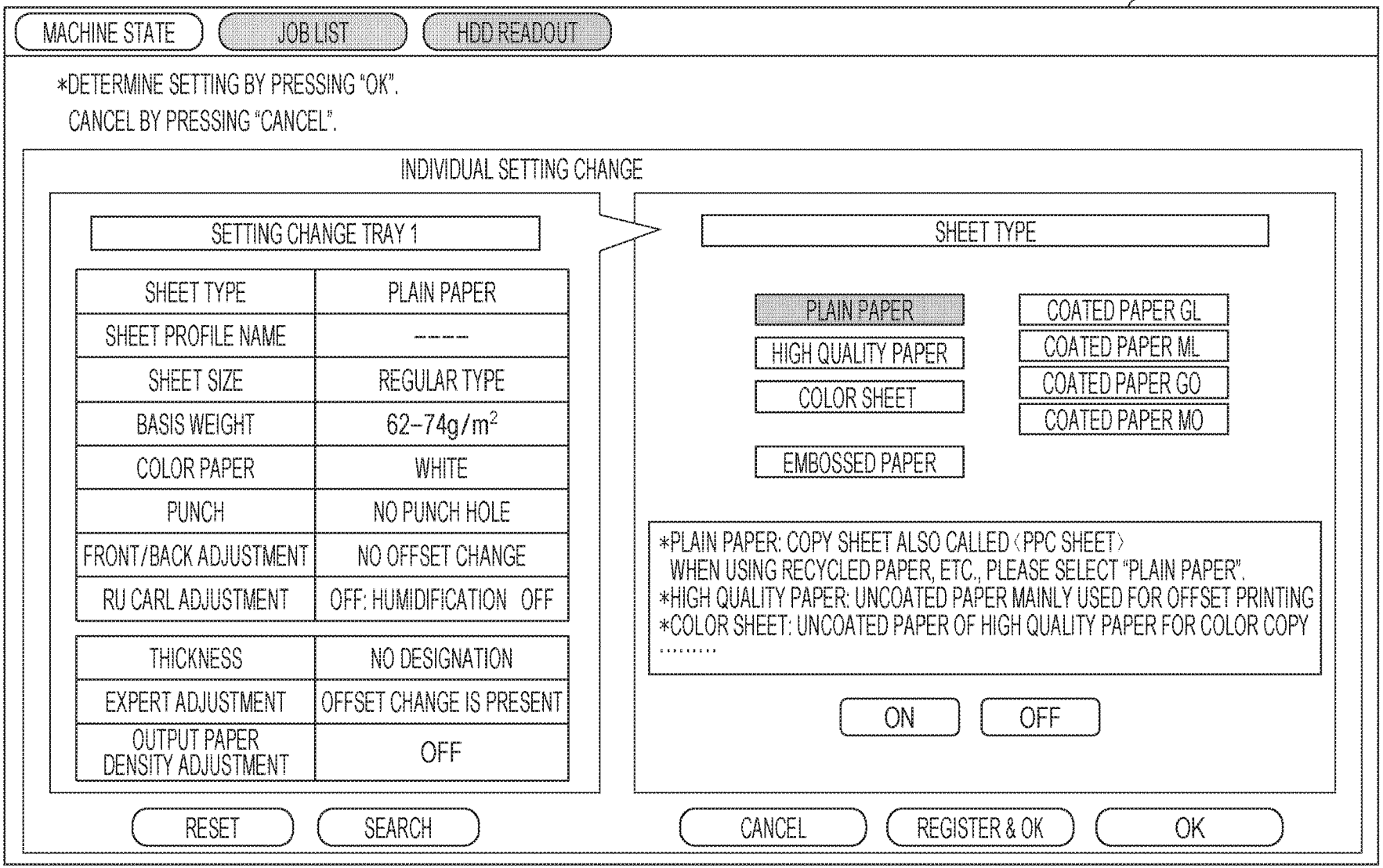
FIG. 10 is a diagram showing an example of a sheet profile setting screen displayed on the operation panel of the image forming apparatus.

In Case of Setting Sheet Profile After Sheet Insertion (1) After inserting sheets into each sheet feed tray to be used in the print job, the operator sets the sheet profile for the sheet feed tray. FIG. 10 shows an example of a sheet profile setting screen 80. On this screen, the setting of the values of each item to be registered in the sheet profile can be changed individually. A sheet profile already registered may be called up and linked to the sheet feed tray. The operator sets the sheet profile for each sheet feed tray that needs the setting.

(2) Every time when receiving the setting of the sheet profile to the sheet feed tray, the image forming apparatus 10 changed the state information of the sheet feed tray to "sheet setting confirmation state" (step S105 in FIG. 5).

Figure 11:
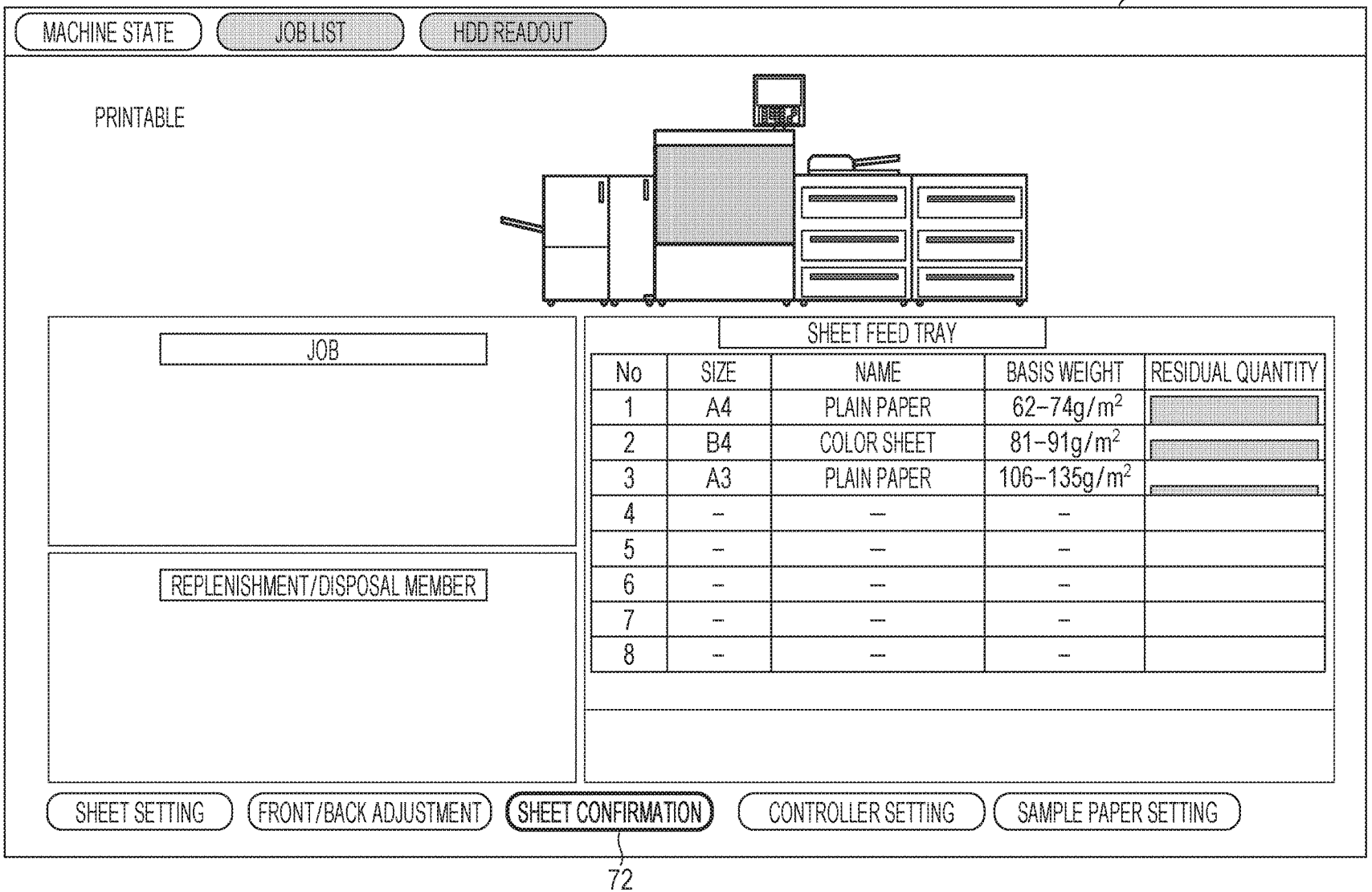
FIG. 11 is a diagram showing an example of an operation screen displayed on the operation panel of the image forming apparatus (in the case of pressing a sheet confirmation button)

(3) Upon completion of the sheet profile setting operation, the operator presses a sheet confirmation button 72 on the operation screen 70 (see FIG. 11).

(4) The image forming apparatus 10 having received this operation feeds the sheet from the sheet feed tray (for example, in order of increasing tray number) for each of the sheet feed trays whose state information is "sheet setting confirmation state" to discharge the sheet to the post-processing unit 8, and also executes the processing shown in FIG. 6. As a result, the physical property value of the sheet being conveyed is measured by the media sensor 13, and the conformity between the sheets set in the sheet feed tray and the sheet profile set in the sheet feed tray is determined.

(5) When the image forming apparatus 10 makes determination of nonconformity (mismatch) (step S204 in FIG. 6; No), advances the processing to step S 207, and displays a recommended sheet setting screen 85 as shown in FIG. 12 on the operation panel 14. On the recommended sheet setting screen 85, sheet profiles are displayed in descending order of degree of conformity in a list. It may be displayed on the recommended sheet setting screen 85 that there is a high possibility that the cause of nonconformity is a setting error of the sheet profile to the sheet feed tray.

Even when the degree of conformity is low, since there are cases where the sheet profile is intentionally set, the recommended sheet setting screen 85 shows the presence of a sheet profile with a higher degree of conformity, instead of warning of nonconformity, and recommends changing the sheet profile set in the sheet feed tray.

When the profile registration button 89 on the recommended sheet setting screen 85 is pressed, the physical property value of the measurement result of the media sensor 13 can be registered in the designated sheet profile.

As described above, when the sheets set in the sheet feed tray and the sheet profile set in the sheet feed tray are unconformable (mismatched), the image forming apparatus 10 according to the embodiment determines whether the cause of the failure is the mistake in placing sheets or the setting error of the sheet profile and inform the operator of the result, and therefore the operator can recognize the type of the mistake and promptly take appropriate measures. In particular, since the recommended sheet setting screen 85 is displayed when it is determined that the cause of the nonconformity is a setting mistake of the sheet profile, the operator can immediately make necessary changes by this displayed screen.

Although embodiments of the present invention have been described and illustrated in detail, specific configurations are not limited to those shown in the embodiments and the disclosed embodiments are made for purposes of illustration and example only and not limitation. The scope of the present invention should be interpreted by terms of the appended claims and changes and additions within the scope not deviating from the gist of the present invention are also included in the present invention.

In the embodiment, the operator is notified of the determination result only in the case of nonconformity, but may also be notified of the determination result even in the case of conformity.

What is claimed is:

1. An image forming apparatus comprising:

a sheet profile setter that sets a sheet profile in a sheet feed tray;

a conveyer that feeds and conveys a sheet from the sheet feed tray;

an image former that forms an image on the sheet conveyed by the conveyer in accordance with an image forming condition determined based on the sheet profile set in the sheet feed tray of a sheet feed source;

a sheet physical property measurer that makes measurement of a physical property value of the sheet being conveyed on a conveyance path of the conveyer;

a conformity determiner that makes determination of conformity between the sheet fed from the sheet feed tray and a sheet indicated by the sheet profile set in the sheet feed tray, based on the physical property value obtained by measuring the sheet fed and conveyed from the sheet feed tray, by the sheet physical property measurer; and a notifier that determines which has been performed more recently between insertion of the sheet into the sheet feed tray and setting of the sheet profile to the sheet feed tray before the measurement relating to the determination made by the conformity determiner so as to send a notification of a result of the determination by a first notification method in a former case and by a second notification method in a latter case.

2. The image forming apparatus according to claim 1, wherein a physical property value of an item to be measured by the sheet physical property measurer is registered in the sheet profile, and the conformity determiner makes the determination by comparing the physical property value obtained by measuring the sheet fed and conveyed from the sheet feed tray by the sheet physical property measurer and the physical property value registered in the sheet property profile set in the sheet feed tray.

3. The image forming apparatus according to claim 2, further comprising a measured value register that registers, in the sheet profile, the physical property value obtained by measuring the sheet by the sheet physical property measurer.

4. The image forming apparatus according to claim 1, wherein a type and a basis weight of the sheet are registered in the sheet profile, and the conformity determiner obtains a type and a basis weight of the sheet based on the physical property value obtained by measuring the sheet fed and conveyed from the sheet feed tray by the sheet physical property measurer, and compares the obtained type and basis weight of the sheet with the type and basis weight of the sheet registered in the sheet profile set in the sheet feed tray to make the determination.

5. The image forming apparatus according to claim 1, further comprising a state manager that switches state information of the sheet feed tray to a inserted sheet confirmation state when the sheet is inserted into the sheet feed tray, switches the state information to a sheet setting confirmation state when the sheet profile is set and registered to the sheet feed tray, and switches the state information to a confirmation unnecessary state when the sheet fed from the sheet feed tray is measured by the sheet physical property measurer, wherein the sheet physical property measurer performs the measurement on condition that the state information of the sheet feed tray is either the inserted sheet confirmation state or the sheet setting confirmation state, and the notifier chooses the first notification method when sending notification of the determination result made by the conformity determiner, based on a result of the measurement executed by the sheet physical property measurer when the state information of the sheet feed tray is the inserted sheet confirmation state, and chooses the second notification method when sending notification of the determination result made by the conformity determiner, based on a result of the measurement executed by the sheet physical property measurer when the state information of the sheet feed tray is the sheet setting confirmation state.

6. The image apparatus according to claim 5, wherein the sheet physical property measurer executes the measurement on the sheet fed from the sheet feed tray when trial printing is performed by feeding the sheet from the sheet feed tray on which the condition is satisfied.

7. The image forming apparatus according to claim 5, wherein the sheet physical property measurer executes the measurement for the sheet feed tray on which the condition is satisfied, based on an instruction from a user.

8. The image forming apparatus according to claim 1, wherein, when the sheet fed from the sheet feed tray and the sheet indicated by the sheet profile set in the sheet feed tray are determined to be unconformable by the conformity determiner, in addition to the notification, the notifier warns that a wrong sheet has been inserted in the sheet feed tray in the first notification method, and sends a notification of a recommended sheet profile in the second notification method.

* * * * *